US006645043B1

(12) United States Patent
Yenawine

(10) Patent No.: US 6,645,043 B1
(45) Date of Patent: Nov. 11, 2003

(54) METHOD AND APPARATUS FOR COLD-END PROCESSING FULL LEAD CRYSTAL

(76) Inventor: Peter W. Yenawine, 517 Walnut La., Swarthmore, PA (US) 19081

( * ) Notice: Subject to any disclaimer, the term of this patent is extended or adjusted under 35 U.S.C. 154(b) by 9 days.

(21) Appl. No.: 09/722,900

(22) Filed: Nov. 27, 2000

Related U.S. Application Data

(63) Continuation of application No. 09/146,626, filed on Sep. 3, 1998, now Pat. No. 6,152,809.

(51) Int. Cl.[7] ..... B24B 7/00

(52) U.S. Cl. ..... 451/5; 451/11; 451/44; 451/66; 451/69; 451/257; 451/260

(58) Field of Search ..... 451/43, 44, 65, 451/66, 69, 257, 260, 37, 38, 39, 449, 182, 184, 536, 11, 5

(56) References Cited

U.S. PATENT DOCUMENTS 6,152,809 A * 11/2000 Yenawine ..... 451/44

* cited by examiner

*Primary Examiner*—M. Rachuba
(74) *Attorney, Agent, or Firm*—Volpe and Koenig, P.C.

(57) ABSTRACT

An apparatus for grinding and polishing without visible flaws a variety of different size and shape full-lead crystal workpieces. A conveyor supports the workpieces and runs through the apparatus housing. A workpiece calibrator is located proximate the entrance end of the housing. A plurality of grinders having an abrasive grinding surface within a range of coarseness are located downline of the calibrator. A plurality of polishers are located downline of the grinders. Control means raises and lowers the calibrator, grinders and polishers relative to the belt conveyor and the unfinished surface of the workpiece supported thereon. A method of automatically making a finished full-lead crystal ornament using an automated machine having a housing, conveyor, a plurality of motor-driven grinding heads, and a plurality of motor-driven polishing heads. The unfinished lead-crystal blank is oriented on the conveyor such that an unfinished work surface of the blank is unobstructed by and extends outwardly from the conveyor. The grinding heads and polishing heads are calibrated to a predetermined location relative to the conveyor and the unfinished work surface of the blank. The work surface is ground by each of the succeeding grinding heads having a less coarse abrasive grinding surface and then polished by each of the next succeeding polishing heads. The blank is reoriented on the conveyor so that a different unfinished work surface is unobstructed by and extends from the conveyor. The grinding and polishing steps are then repeated on each unfinished work surface.

20 Claims, 9 Drawing Sheets

METHOD AND APPARATUS FOR COLD-END PROCESSING FULL LEAD CRYSTAL

This is a continuation of prior application Ser. No. 09/146,626 filed Sep. 3, 1998 now U.S. Pat. No. 6,152,809.

FIELD OF THE INVENTION

The present invention relates to an automated method and apparatus for cold-end processing full-lead crystal. More particularly, the invention relates to an automated method and apparatus for grinding and polishing full-lead crystal ornaments, figurines, trophies, and the like.

BACKGROUND OF THE INVENTION

Cold-end processing of full-lead crystal workpieces such as decorative ornaments, figurines, trophies, or the like (hereinafter "ornaments") is a very labor intensive industry. To make a full-lead crystal ornament, craftsmen first rough cut, carve or grind the ornament from a slab of full-lead crystal. The slabs, when provided from the material manufacturer, typically weigh about 15–60 pounds depending on the specific finished product, and have dull, uneven, unpolished surfaces.

After the ornament is rough cut or carved from the slab, each surface must be ground and polished to a clear, brilliant finish. In the prior art, each surface is first hand ground three times with a progressively finer grinding surface. Each surface is then hand polished three times with a progressively finer polishing surface. This six step grinding/polishing process must be performed on each outer surface of the ornament.

Since the process of cold-end finishing full-lead crystal ornaments is very labor intensive, automation of even a portion of the finishing process would significantly reduce the overall cost of the ornament. It is estimated that the cost of cutting, grinding and polishing the ornament comprises at least about 80 percent of the ornament's factory cost whereas the cost of the lead-crystal material comprises no more than about 20 percent of the factory cost. Therefore, it would be desirable to reduce the amount of hand labor involved in cold-end finishing full-lead crystal ornaments in order to reduce the overall cost of the ornament.

Some industries teach automated machines for grinding and/or polishing materials having significantly different properties than full-lead crystal. For example, in the marble and granite industry, the Mantello honing machine, Officina Meccanica Antonino Mantello, Catania, Italy, is known for polishing the face surface of large marble or granite workpieces. In the plate glass industry, the Bovone straight line edging machine, Bovone Elettromeccanica, Belforte Monferrato, Italy, is known for edge finishing sheets of plate glass having a material thickness in the range of 2 mm to 25 mm. While the Mantello honing machine and the Bovone edge finishing machine provide a finished surface which is acceptable for marble, granite, and plate glass, respectively, the Mantello honing machine (in its original unmodified condition) cannot provide the clear, brilliant surface finish required for full-lead crystal ornaments and the Bovone straight line edging machine does not have the widthwise capacity to process common full-lead crystal ornaments. Therefore, it would also be desirable to provide an automated apparatus and method capable of providing a finish which is clear and brilliant enough for full-lead crystal, i.e., without visible flaws.

SUMMARY OF THE INVENTION

The present invention provides a system of automated apparatus for cutting, beveling, grinding, and polishing, the flat, outer surfaces of full-lead crystal ornaments to a finish which is clear and brillant, and without visible flaws. One apparatus of the system automatically grinds and polishes the large flat face surfaces of a full-lead crystal workpiece. Another apparatus automatically bevels, grinds and polishes the edge surfaces of a full-lead crystal workpiece. Another apparatus automatically cuts intricate shapes in the workpiece.

The face surface finishing apparatus has a housing, a conveyor for carrying the workpiece through the housing, a calibrator, a plurality of grinders, a plurality of polishers, and control means for raising and lowering the calibrator, grinders, and polishers relative to the conveyor and the workpiece supported thereon. The calibrator, grinders and polishers are located above the conveyor belt.

The conveyor preferably includes a horizontal, variable-speed, endless-belt conveyor running lengthwise downline through the housing from the entrance end to the exit end. The conveyor also includes a pair of unpowered, roll conveyors, one located proximate the entrance end and the other located proximate the exit end of the belt-conveyor.

The calibrator is located proximate the entrance end of the housing. The calibrator has a leading, abrasive cutting surface which course grinds the workpiece to a desired thickness. Preferably, the calibrator abrasive cutting surface has a coarseness in the range of about 30 grit to about 50 grit.

The grinders are located downline from the calibrator. Each of the grinders has a motor and a grinding head having an abrasive grinding surface within a range of coarseness, preferably in the range of about 60 grit to about 800 grit. The grinding heads comprise a circular base plate having replaceable grinding pads releasably attached to the base plate. The grinders are arranged sequentially downline within in the housing in an order of decreased coarseness.

The polishers are arranged downline from the grinders within the housing. Each of the polishers has a motor and a polishing head having a coarseness in the perforated pad range. The polishing heads preferably comprise a circular base plate having replaceable polishing pads. The polishing heads are used in conjunction with a polishing compound, preferably cerium oxide.

The control means raises and lowers the calibrator head, grinding heads and polishing heads relative to the conveyor and the unfinished surface of the workpiece supported by the conveyor. The control means also sequentially lowers and raises each of the grinding heads and polishing heads into contact with the workpiece being conveyed downline on the conveyor.

Lubricating fluid nozzles are located around the calibrator head, polishing heads, and grinding heads. The nozzles are connected to a separate sources of lubricating fluid and polishing and direct the flow of fluid onto the unfinished surface of the workpiece during grinding and polishing. A valve controls the flow of fluid through each of the nozzles. A collection basin is located underneath the housing for collecting and recycling the fluid emitted from the nozzles. A dryer is located proximate the exit end of the housing for removing residual fluid from the workpiece.

The edge surface finishing apparatus has a housing, a conveyor for carrying the workpiece through the housing, a plurality of grinders, a plurality of polishers, and control means for raising, lowering and tilting the grinders and polishers relative to the conveyor and the workpiece supported thereon.

The conveyor includes a processing conveyor comprising a pair of opposed, vertically-oriented, variable-speed, endless-belt conveyors running lengthwise downline through the housing from the entrance end to the exit end. The processing grasps or "sandwiches" the face surfaces of the workpiece and suspends the unfinished edge surface oriented downwardly. The processing conveyor has means for adjusting the distance between the belts to accomodate a variety of workpieces having different thicknesses.

The conveyor also includes horizontal load and unload belt conveyors located in line with the entrance end and the exit end of the processing conveyor. The entrance end load conveyor "feeds" workpieces into the edge surface finishing apparatus. The exit end unload conveyor "removes" workpieces from the edge surface finishing apparatus.

The grinders and polishers are located underneath the vertical belt conveyor. Each of the grinders has a motor and a grinding head having an abrasive grinding surface within a range of coarseness, preferably in the range of about 60 grit to about 800 grit. The grinders are arranged sequentially downline within the housing in an order of decreased coarseness.

The polishers are arranged downline from the grinders within the housing. Each of the polishers has a motor and a polishing head having a coarseness in the felt pad range. The polishing heads preferably comprise a circular base ring having replaceable polishing felt pads. The polishing heads are used in conjunction with a polishing compound, preferably cerium oxide.

The control means raises, lowers and tilts the grinding heads and polishing heads relative to the processing conveyor and the unfinished edge surface of the workpiece supported by the processing conveyor. The control means positions the grinding heads and polishing heads so that each of the heads properly contacts the bottom surface of the workpiece as processed by the preceding head.

Lubricating fluid nozzles are located around each of the polishing heads and grinding heads. The nozzles are connected to separate sources of lubricating fluid and polishing fluid, and direct the flow of fluid onto the unfinished surface of the workpiece during grinding and polishing. A valve controls the flow of fluid through each of the nozzles. A collection basin is located underneath the housing for collecting and recycling the fluid emitted from the nozzles.

The cutting apparatus comprises a high-pressure fluid cutting machine such as an Ingersoll-Rand® Waterjet cutting machine.

The present invention also provides an automated method of cutting, beveling, grinding, and polishing, full-lead crystal ornaments using one or more of the finishing apparatus described above. An unfinished lead-crystal workpiece is oriented on a conveyor such that a first work surface of the workpiece is unobstructed by and extends outwardly from the conveyor. The workpiece is conveyed over a series of progressively finer grinding heads and polishing heads which are positioned relative to the conveyor and the unfinished work surface of the workpiece. The work surface is simultaneously lubricated with a fluid during grinding and polishing.

After the first work surface is ground and polished, the workpiece is reoriented on the conveyor so that a Liv different unfinished work surface is unobstructed by and extends from the conveyor. The above-described grinding and polishing steps are repeated until each of the desired work surfaces are finished.

DESCRIPTION OF PREFERRED EMBODIMENTS

Figure 1:
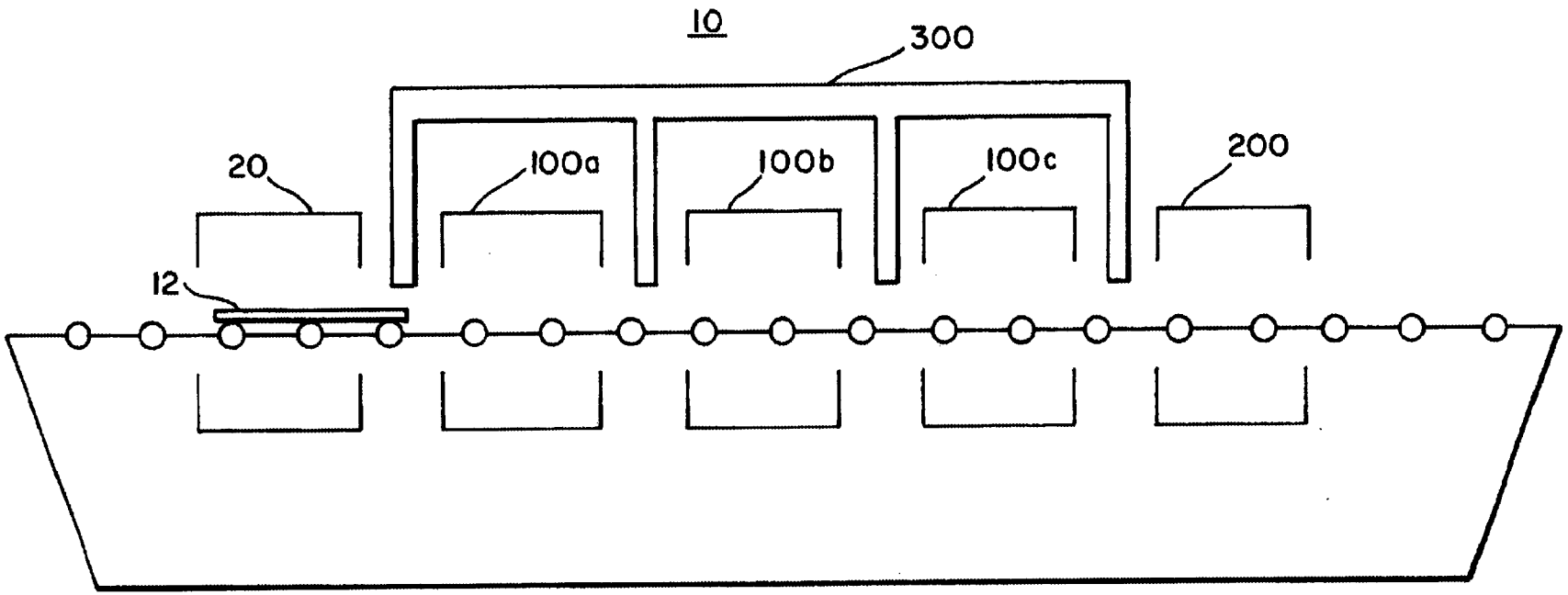
FIG. 1 is a schematic illustration of the full-lead crystal automatic processing system in accordance with an embodiment of the invention.
Figure 2:
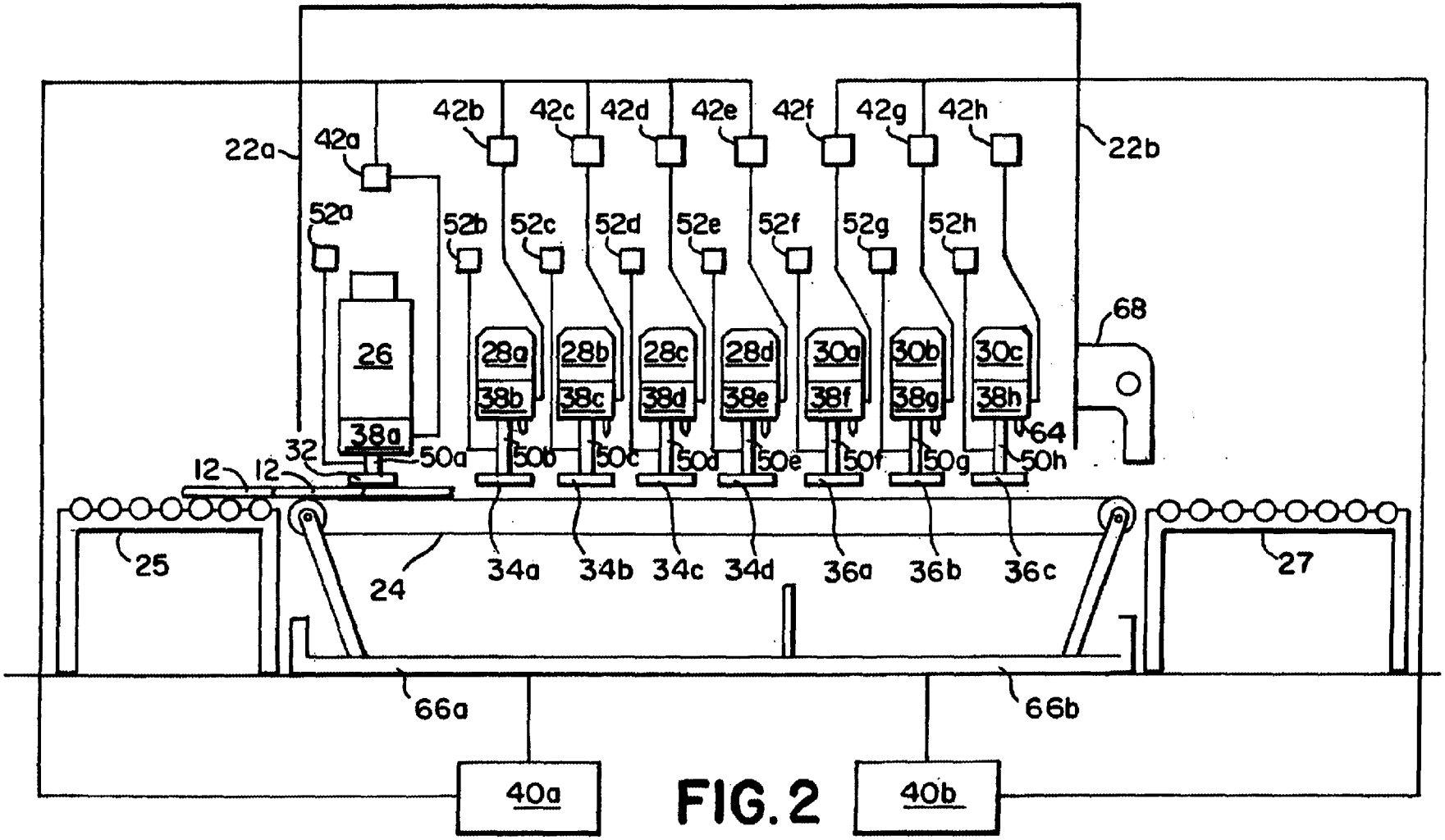
FIG. 2 is a schematic illustration of a face surface finishing apparatus in accordance with an embodiment of the invention.

The present invention is described below with reference to FIGS. 1–17 wherein like reference numerals are used throughout to designate like elements.

The cold-end, full-lead crystal processing system of the present invention is illustrated schematically in FIG. 1 and is designated generally be reference numeral 10. The system comprises a plurality of specialized surface finishing apparatus. One apparatus 20 is constructed and arranged for grinding and polishing large flat face surfaces of an unfinished full-lead crystal workpiece 12. Another apparatus 100 is constructed and arranged for grinding and polishing the elongate, flat edge surfaces of a full-lead crystal workpiece 12. Yet another apparatus 200 is constructed and arranged for precision cutting intricate patters in a full lead-crystal workpiece 12. The apparatus 20, 100, and 200 are each self-contained units. In a preferred embodiment, the system comprises several edge surface finishing apparatus 100*a*, 100*b*, 100*c*, each of which is specially designed to handle different sizes of workpiece 12. The components 20, 100*a*, 100*b*, 100*c*, 200 may be remotely located from one another or connected by powered roller conveyors 14 which convey the workpiece 12 from one apparatus to another. The system 10 may also include means for reorienting the workpiece as the workpiece is conveyed from one component to another. Such means may include robotic arms 300 which releasably grasp and rotate the workpiece.

The face surface finishing apparatus 20 is described in greater detail with reference to FIGS. 2–7. The face surface finishing component 20 is designed primarily to automatically grind and polish large flat slabs which are then cut into smaller pieces for further processing. However, the face surface finishing apparatus may also be used to grind and polish the flat face surfaces of a large dimensional piece of full-lead crystal (ornament).

The face surface finishing apparatus 20 has a housing 22 with an entrance end 22*a* and an exit end 22*b*. A conveyor system supports and carries workpieces 12 downline from a loading area, through the housing 22, and out to an unload area. The conveyor system comprises a load conveyor 25 leading from the load area to the housing entrance, an unload conveyor 27 leading from the housing exit end to the unload area, and a processing conveyor 24 extending through the housing intermediate the load and unload conveyors. The processing conveyor 24 is preferably a variable-speed, horizontally-oriented, endless-belt conveyor 24 located within and extending the length of the housing 22. The load and unload conveyors are preferably unpowered, roller conveyors located in line with the processing conveyor 24 proximate the entrance end 22*a* and exit end 22*b*, respectively, of the housing 22.

The workpieces should be loaded onto the load conveyor 25 with the unfinished work surface facing up. The load conveyor 25 is preferably not powered so that the workpiece 12 may be pushed forward onto the belt conveyor 24 and abutted with a previously loaded workpiece 12 to form a contiguous series of individual workpieces 12. The workpieces 12 should preferably be loaded in a contiguous, abutting configuration so that the grinding/polishing lubricating fluid (described below) flows from the top surface of one workpiece to the top surface of another workpiece.

The face surface finishing component 20 has a calibrator 26, a plurality of grinders 28, and a plurality of polishers 30, respectively, arranged in-line within the housing 22 above the processing conveyor 24. The calibrator 26 course grinds the workpieces 12 to a desired thickness. The grinders 28 and polishers 30 then automatically grind and polish the surface with progressively finer heads until the workpiece attains a brilliant finish.

The calibrator 26, grinders 28*a*–28*d* and polishers 30*a*–30*c* each have a rotating head 32, 34*a*–34*d*, 36*a*–36*c*, respectively, which is driven by a separate electric motor, 38*a*, 38*b*–38*e*, 38*f*–38*h*, respectively. In the embodiment illustrated in FIG. 2, the calibrator motor is variable speed and generates about 10 h.p. while the grinding and polishing motors are single speed and generate about 5.5 h.p. Each of the motors rotate at about 500 revolutions per minute.

The calibrator includes an actuator 50*a* which raises and lowers the calibrator grinding head 32 relative to the processing conveyor 24 and the workpiece 12 supported thereon. The grinders 28 and the polishers 30 also have actuators 50*b*–50*e*, 50*f*–50*h*, respectively, which raise and lower the grinding and polishing heads 34*a*–34*d*, 36*a*–36*c*, respectively, relative to the processing conveyor 24 and the workpiece 12 supported thereon. In a preferred embodiment, the actuators 50*b*–50*e*, 50*f*–50*h* comprise hydraulic pistons which provide an upward lifting force to disengage the polishers and grinders from the workpiece. To engage the workpiece, the hydraulic pistons are released or "bled" so that gravity pulls the grinders and polishers into contact with the workpiece. Preferably, the hydraulic pistons do not apply a downward force to increase the pressure of the grinding or polishing heads. Rather, pressure between the grinding and polishing heads and the workpiece is created only by the weight of the grinders and polishers.

Each actuator 50 is connected to a controller 52*b*–52*h*. The controllers 52 sequentially lower each of the grinders heads and polishers into contact with the first workpiece being conveyed downline on the conveyor. After the last workpiece is conveyed downline, the actuators sequentially lift the grinders and polishers so that. they do not fall onto the conveyor belt.

Figure 3:
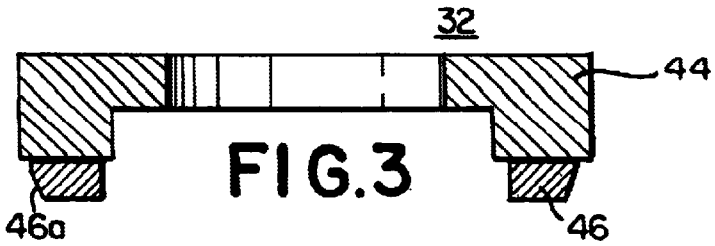
FIG. 3 is a side elevation of a calibrater head in accordance with an embodiment of the invention.
Figure 4:
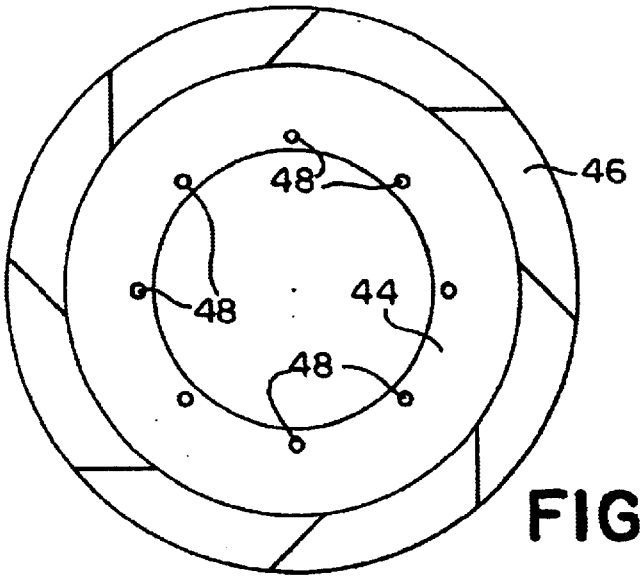
FIG. 4 is a top plan view of a grinding head in accordance with an embodiment of the invention.

A calibrator head 32 is shown in greater detail in FIGS. 3 and 4. The calibrator head base plate 44 has an annular, grinding ring 46 fixed to one side proximate the outer perimeter of the base plate 44. The grinding ring 46 may be made from an abrasive material such as diamond in a bronze bond. The base plate 44 has a series of apertures 48 proximate the inner perimeter through which fasteners are inserted for mounting the calibrator head 32. Since the calibrator is designed to initially remove large amounts of material from the slab/workpiece 12, the grinding ring 46 has a very rough surface, preferably 30–50 grit, and has a tapered leading edge 46*a* to cut into the leading edge of the slab/workpiece 12. In a preferred embodiment, the calibrator head 32 is about 14 inches in diameter.

Figure 5:
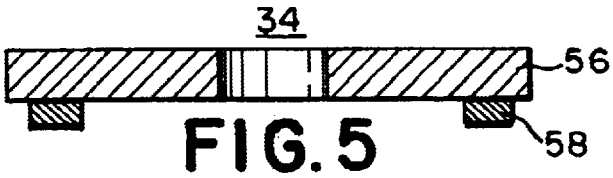
FIG. 5 is a side elevation of the grinding head shown in FIG. 4.
Figure 6:
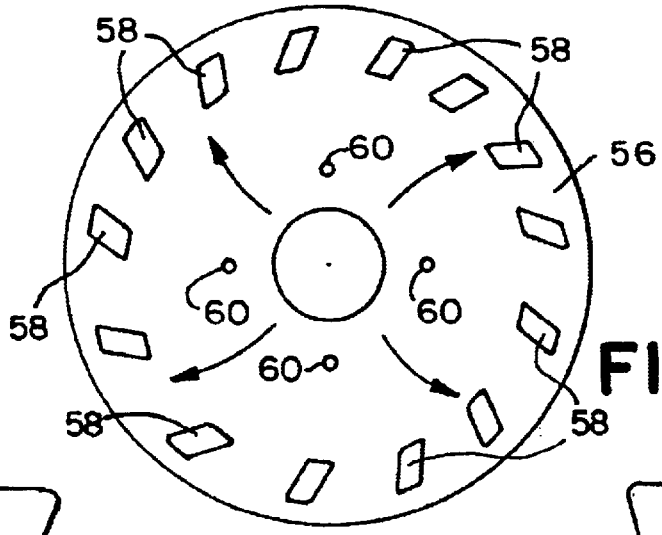
FIG. 6 is an enlarged plan view of a replaceable grinding disc of the grinding head shown in FIG. 4.
Figure 7A:
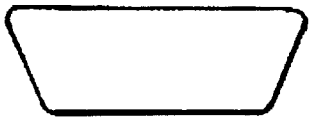
FIG. 7 is a side elevation of the replaceable grinding pad shown in FIG. 6.
Figure 7B:
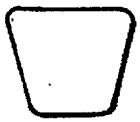

A grinding head 34 is shown in greater detail in FIGS. 5–7. The circular base plate 56 has a plurality of replaceable, grinding pads 58 removably fixed thereto. The grinding pads may be made from an abrasive material such as diamond in a metal bond to diamond in a resin bond. The base plate 56 has a series of apertures 60 proximate both the inner and outer perimeter through which fasteners are inserted for mounting the grinding head 35. In a preferred embodiment, the base plate is approximately 14 inches in diameter.

The replaceable grinding pads 58 are arranged in a radial pattern around the outer perimeter of the base plate 56. The replaceable pads 58 have a trapezoidal shape as best seen in FIG. 6. The grinding pads 58 have a tapered leading grinding surface as best seen in FIG. 7. In a preferred embodiment, the grinding pads are glued to the base plate 56 which is bolted to the grinding head.

Lubricating fluid nozzles 64 are located around the head of the calibrator 32. Lubricating fluid nozzles are also located around each grinding head 34 and each polishing head 36. The nozzles proximate the calibrator head 32 and the grinding heads 34 are connected to a lubricating fluid source 40*a* through a control valve 42*a*–42*e*. The lubricating fluid is preferably water and is supplied to each head at a rate of about 4.1 gallons per minute. The nozzles 64 direct the lubricating fluid onto the top surface of the workpiece 12 during grinding. The lubricating fluid runoff is-collected in a basin 66*a* located underneath the processing conveyor 24. Preferably, the lubricating fluid runoff is recycled to the lubricating fluid source 40*a* after removing any grinding residue contained therein.

As shown by fluid flow lines in FIG. 6, lubricating fluid is dispersed from a lubricating fluid nozzle through the center of a grinding head and is dispersed radially outwardly across the work surface of the workpiece.

The nozzles proximate the polishing heads 36 are connected to a polishing fluid source 40*b* through control valves 42*f*–42*h*. The polishing fluid is preferably a water and cerium oxide mixture and is supplied to each head at a rate of about 2.1 gallons per minute. The nozzles 64 direct the fluid onto the top surface of the workpiece 12 during polishing. The fluid runoff is collected-in a basin 66*b* located underneath the processing conveyor 24. Preferably, the lubricating fluid runoff is recycled to the polishing fluid source 40*b* after removing any grinding residue contained therein. The basins 40*a* and 40*b* are segregated to prevent the lubricating fluid from mixing with the polishing fluid.

A forced air dryer 68 is located proximate the exit end of the belt conveyor 24. The dryer 68 operates at about 3.7 kilowatts cubic feet per minute. The dryer 68 removes any residual fluid on the workpiece 12 so that a workman can safely carry the workpiece back to the front of the face surface finishing apparatus 20 for another surface finishing pass, or to another component 100 at a different work station.

The apparatus 20 is preferably designed to handle large, flat workpieces up to 12 inches wide and ¾ to 5 inches thick. Workpieces less than about ¾ inches thick should preferably be temporarily fixtured before processing in the apparatus 20.

In operation, the workpieces 12 are initially loaded onto the load conveyor 25 in an abutting arrangement. The belt conveyor 24 carries and supports the workpiece through the apparatus 20. The top surface of the workpiece 12 is automatically ground and polished to the desired thickness, dried, and conveyed to the unload conveyor. If another surface on the workpiece requires finishing, the workpieces 12 are sent through the apparatus 20 once again. In a preferred embodiment, the total processing time for one surface is about 20 minutes.

Figure 8:
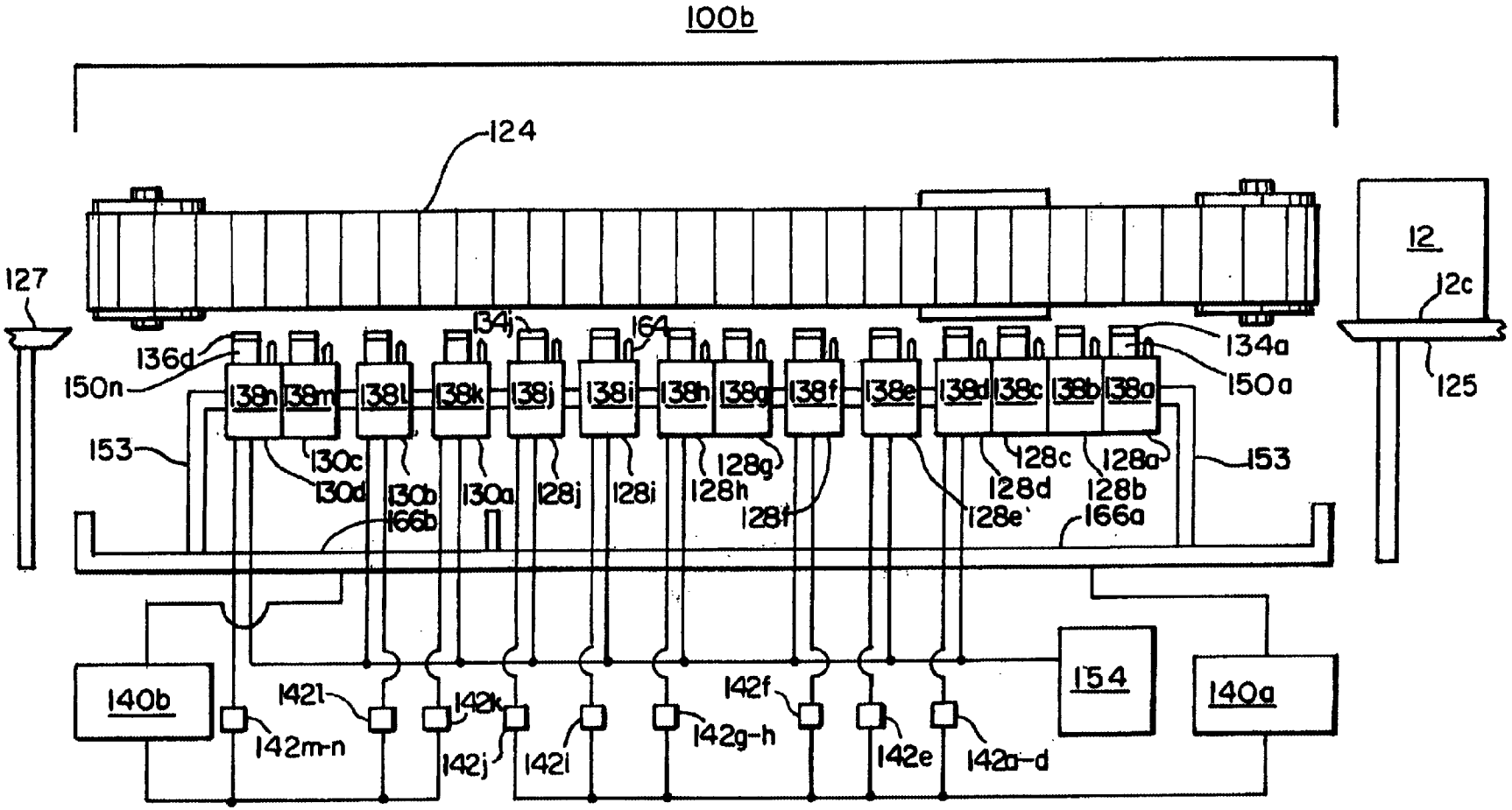
FIG. 8 is a schematic illustration of an edge surface finishing apparatus in accordance with an embodiment of the invention.
Figure 9A:
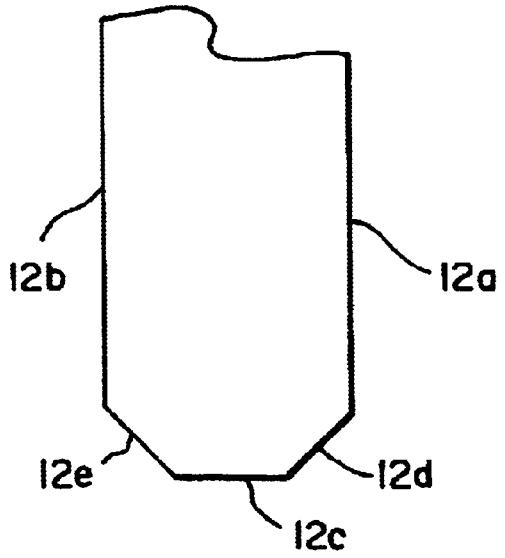
FIGS. 9*a* and *b* are schematic illustrations of the workpiece suspended by a conveyor shown in relation to a grinding head of the edge surface finishing apparatus of FIG. 8.
Figure 9B:
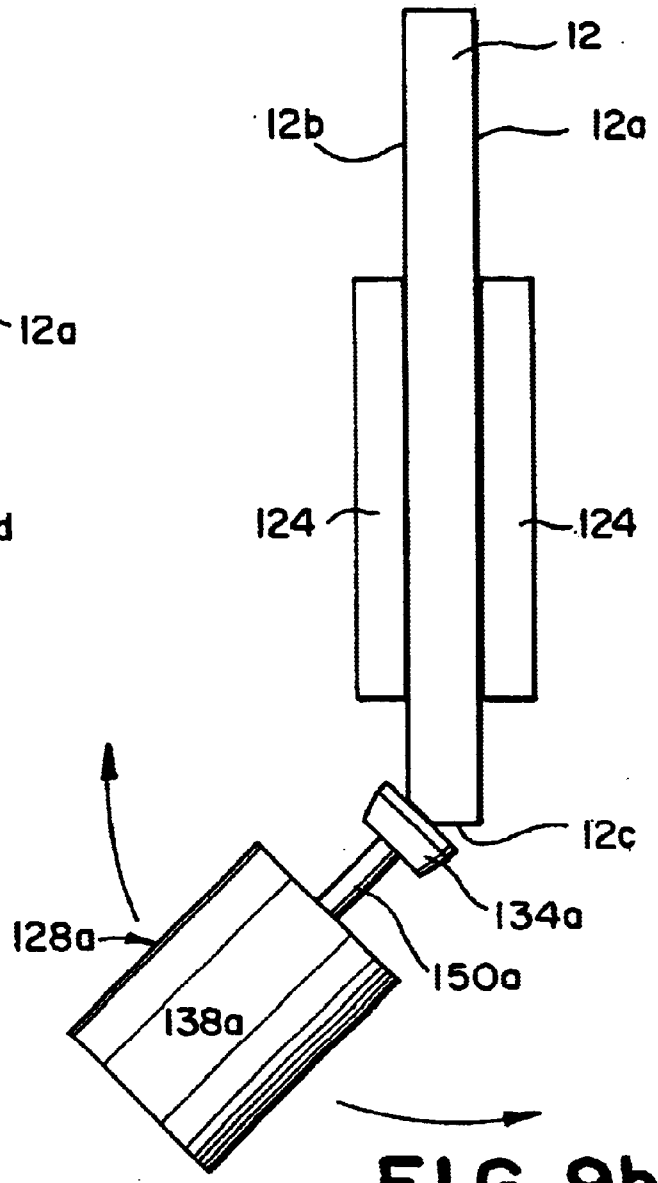
FIG. 9*c* is an enlarged fragmented side elevation of a workpiece showing various unfinished work surfaces.

The edge surface finishing apparatus 100 is described in greater detail with reference to FIGS. 8,9 and 9*a*. The edge surface finishing component 100 automatically grinds and polishes the elongate, edge surfaces of the workpiece. The edge surface finishing apparatus 100 can grind and polish a flat edge surface perpendicular to the face surface. The apparatus can also grind and polish a flat edge surface transverse to the face surface, i.e., provide a bevelled edged. The apparatus 100 can grind and polish large crystal slabs which are then cut into smaller pieces for further processing. The apparatus can also grind and polish large or small dimensional pieces of full-lead crystal (ornaments).

The edge surface finishing component 100 has a housing 122 with an entrance end 122*a* and an exit end 122*b*. A conveyor system supports and carries one or more workpieces 12 downline through the housing 122. The conveyor system comprises a load conveyor 125, an unload conveyor 127, and a processing conveyor 124 intermediate the load and unload conveyors. The processing conveyor 124 is preferably a pair of opposed variable-speed, vertically-oriented, endless-belt conveyors located within and extending the length of the housing 122. Referring to FIG. 9, the belt conveyors 124 grasp or "sandwich" the workpiece on its opposed face surfaces 12*a*, 12*b*, thereby leaving its bottom edge surface 12*c* unobstructed by the conveyor belts 124. The distance between the opposed conveyor belts 124 is adjustable for grasping workpieces within a range of thicknesses.

The load 125 and unload 127 conveyors are preferably powered, belt conveyors located in line with the processing conveyor 124 proximate the entrance end 122*a* and exit end 122*b*, respectively, of the housing 122. The workpiece is oriented on the load conveyor 125 such that the edge surface to be beveled/finished 12*c* is oriented face down. The workpiece 12 is conveyed forward by the load conveyor 125 and grasped by the processing conveyor 124. The processing conveyor 124 carries the workpiece 12 through the apparatus 100 and delivers the finished workpiece to the unload conveyor 127.

The edge surface finishing component has a plurality of grinders 128 and a plurality of polishers 130 arranged in-line within the housing 122 underneath the processing conveyor 124. The grinders 128 and polishers 130 automatically grind and polish the surface with progressively finer heads until the workpiece attains the desired shape and finish.

The grinders 128*a*–128*j* and polishers 130*a*–30*d* each have a rotating head 134*a*–134*j*, 136*a*–136*d*, respectively, which is driven by a separate electric motor, 138*a*–*j*, 138*k*–138*n*, respectively. In the embodiment illustrated in FIG. 8, the motors generate about 2.7 horsepower and rotate at about 1000 revolutions per minute.

An actuator 150 raises, lowers and tilts the grinders 128 and polishers 130 relative to the processing conveyor 124 and the unfinished work surface of the workpiece 12 supported thereon. Each actuator 50 is connected to a controller 154 which controls the linear and angular position of each grinder 128 and polisher 130 relative to the processing conveyor 124 and the unfinished work surface of the workpiece supported thereon.

The grinders 128 and polishers 130 are mounted on rocker assemblies 153 which allow the grinders 128 and polishers 130 to be rotated about the unfinished work surface of the workpiece 12. For example, referring to FIG. 9*b*, the first grinder 128*a* can be rotated relative to the workpiece 12 to change the bevel angle between the grinding head 134*a* and the face surface 12*b*.

The number of grinders 128 and polishers 130 can be varied to meet the specific needs of the operator. For example, in the embodiment illustrated in FIGS. 8 and 9, the apparatus has 10 grinders and 4 polishers. In other embodiments, the apparatus has 7 grinders and 3 polishers; in a further embodiment, the apparatus has 13 grinders and 4 polishers.

The grinders 128 and polishers 130 are preferably arranged in sets which are constructed and arranged to grind and polish a specific edge surface of the workpiece 12. In the 14 head edge finishing apparatus shown in FIG. 8, the first four grinders 128*a*–128*d* are designed to coarse grind the bottom surface 12*c* of the workpiece. The fifth grinder 128*e* is designed to coarse grind a small bevelled edge or seam 12*d* on the front surface. The sixth grinder 128*f* is designed to coarse grind a small bevelled edge or seam 12*e* on the back surface. The seventh and eighth grinders 128*g*, 128*h* fine grind the bottom surface 12*c*. The ninth grinder 128*i* fine grinds the back seam 12*d*. The tenth grinder 128*j* fine grinds the front seam 12*e*. The first polisher 130 fine polishes the front seam 12*d*. The second polisher 130*b* fine polishes the back seam 12*e*. The third and fourth polishers 130*c*, 130*d* fine polish the bottom surface 12*c*. The function and coarseness of each grinder and polisher is summarized below in Table I.

TABLE I

Fourteen-Head Edge Finishing Apparatus

| ELEMENT/HEAD | FUNCTION | COARSENESS |
|---|---|---|
| Grinder 1 (128a) | Coarse grind bottom edge (12c) | 30–50 |
| Grinder 2 (128b) | Coarse grind bottom edge (12c) | 30–100 |
| Grinder 3 (128c) | Coarse grind bottom edge (12c) | 220 |
| Grinder 4 (128d) | Coarse grind bottom edge (12c) | 400 |
| Grinder 5 (128e) | Coarse grind front seam (12d) | 110 |
| Grinder 6 (128f) | Coarse grind back seam (12e) | 110 |
| Grinder 7 (128g) | Fine grind bottom edge (12c) | 400 |
| Grinder 8 (128h) | Fine grind bottom edge (12c) | 600 |
| Grinder 9 (128i) | Fine grind back seam (12d) | 400 |
| Grinder 10 (128j) | Fine grind front seam (12e) | 400 |
| Polisher 1 (130a) | Fine polish front seam (12d) | Polishing felt |

TABLE I-continued

Fourteen-Head Edge Finishing Apparatus

| ELEMENT/HEAD | FUNCTION | COARSENESS |
|---|---|---|
| Polisher 2 (130b) | Fine polish back seam (12e) | Polishing felt |
| Polisher 3 (130c) | Fine polish bottom edge (12c) | Polishing felt |
| Polisher 4 (130d) | Fine polish bottom edge (12c) | Polishing felt |

Grinder head nos. 1, 2, 3, 5 and 6 are diamond in a resin bond. Grinder head nos. 4, 7, 8, 9 and 10 are diamond in a resin bond. The polishes are used in conjunction with a cerium oxide mixture.

In a preferred embodiment, the fourteen-head edge finishing apparatus 100*b* comprises a Bovone 14 straight line edging machine modified in accordance with the teachings of the present invention.

A seventeen-head edge finishing apparatus 100*c* is summarized below in table II. The apparatus 100*c* has additional grinding and polishing wheels which are specifically designed to grind and polish large bevelled edges on the front or back face of the workpiece 12. In a preferred embodiment, the seventeen-head edge finishing apparatus 100*c* comprises a Bovone 17 straight line edge finishing machine which has been modified in accordance with the teachings of the present invention.

TABLE II

Seventeen-Head Edge Finishing Apparatus

| ELEMENT/HEAD | FUNCTION | COARSENESS |
|---|---|---|
| Grinder 1 | Coarse grind bottom edge or primary bevel | 30–50 |
| Grinder 2 | Coarse grind bottom edge or primary bevel | 80–110 |
| Grinder 3 | Coarse grind bottom edge or primary bevel | 220–320 |
| Grinder 4 | Fine grind bottom edge or primary bevel | 320–400 |
| Grinder 5 | Fine grind bottom edge or primary bevel | 600–800 |
| Polisher 1 | Fine polish bottom edge or primary bevel | Polishing felt |
| Grinder 6 | Course grind bottom | 110 |
| Grinder 7 | Coarse grind front seam | 110 |
| Grinder 8 | Coarse grind back seam | 110 |
| Grinder 9 | Fine grind bottom | 320–800 |
| Grinder 10 | Fine grind bottom | 320–800 |
| Grinder 11 | Fine grind back seam | 320–800 |
| Grinder 12 | Fine grind front seam | 320–800 |
| Polisher 2 | Fine polish fron seam | Polishing felt |
| Polisher 3 | Fine polish back seam | Polishing felt |
| Polisher 4 | Fine polish bottom edge | Polishing felt |
| Polisher 5 | Five polish bottom edge | Polishing felt |

Grinder head nos. 1, 2, 3, 6, 7 and 8 are diamond in a metal bond. Grinder head nos. 4, 5, 9 10, 11 and 12 are diamond in a resin bond. The polishers are used in conjunction with a cerium oxide mixture.

A ten head edge finishing apparatus 100*a* is summarized below in Table III.

TABLE III

Ten-Head Edge Finishing Apparatus

| ELEMENT/HEAD | FUNCTION | COARSENESS |
|---|---|---|
| Grinder 1 | Coarse grind front bevel | 30–50 |
| Grinder 2 | Coarse grind front bevel | 80–100 |
| Grinder 3 | Coarse grind front bevel | 220–310 |
| Grinder 4 | Fine grind front bevel | 320–800 |
| Grinder 5 | Fine grind front bevel | 320–800 |
| Grinder 6 | Fine grind front bevel | 320–800 |
| Grinder 7 | Fine grind front bevel | 320–800 |
| Polisher 1 | Fine polish front bevel | Polishing felt |
| Polisher 2 | Fine polish front bevel | Polishing felt |
| Polisher 3 | Fine polish front bevel | Polishing felt |

Figure 9C:
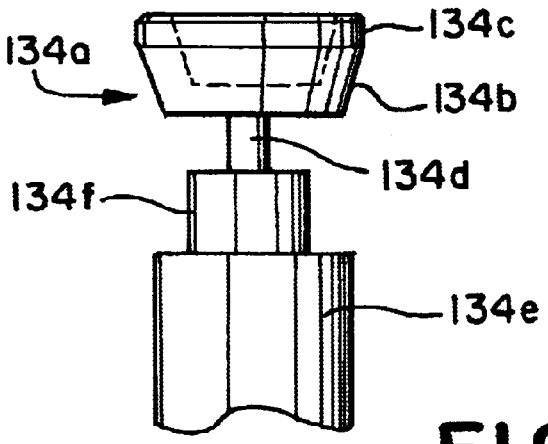

A grinding head 134 is shown in greater detail in FIG. 9*c*. The griding head 134*a* includes a grinding wheel 134*b* on which an abrasive material or felt 134*c* is mounted. The grinding head 134*a* is mounted on a spinning shaft 134*d* connected to a motor 134*e* having a collar 134*f* around the shaft 134*d*. The grinding heads may be made from an abrasive material such as diamond in a metal bond or resin bond. In a preferred embodiment, the grinding heads are approximately 6 inches in diameter.

A lubricating fluid nozzle 164 is located proximate each grinding head 134 and each polishing head 136. The nozzles 164*a–j* proximate the grinding heads are connected to a lubricating fluid source 140*a* through a control valve 142*a*–142*j*. The lubricating fluid is preferably water and is supplied to each head at a rate of about 4.1 gallons per minute. The nozzles 164 direct the lubricating fluid onto the bottom edge surface and bevelled edge surfaces of the workpiece 12 during grinding. The lubricating fluid runoff is collected in a basin 166*a* located at the bottom of the housing 122 underneath the processing conveyor 124.

The nozzles 164*k–n* proximate the polishing heads are connected to a polishing fluid source 140*b* through a control valve 142*k*–142*n*. The polishing fluid is preferably a water and and cerium oxide mixture and is supplied to each head at a rate of about 2.1 gallons per minute. The nozzles 164 direct the polishing fluid onto the bottom edge surface and bevelled edge surface of the workpiece 12 during polishing. The polishing fluid run off is collected in a basin 166*b* located at the bottom of the housing 122 underneath the processing conveyor 124. Preferably both the lubricating fluid and the polishing fluid are recycled to the lubricating fluid source 140*a* and polishing fluid source 140*b* respectively, after removing any residue contained therein. The basins 140*a* and 140*b* are segregated to prevent the lubricating fluid from mixing with the polishing fluid.

The ten-head apparatus 100*a* is designed to handle workpieces up to 25 mm thick. The fourteen-head apparatus 100*b* is designed to handle workpieces up to 55 mm thick. The seventeen-head apparatus is designed to handle workpieces up to 60 mm thick.

In operation, the workpieces 12 are initially loaded onto the load conveyor 125 with the unfinished edge surface facing down. The workpiece 12 is then conveyed into the processing 124 which carries and supports the workpiece through the apparatus 100. The bottom surface of the workpiece 12 is automatically ground and polished to the desired thickness and shape, including bevelled surfaces, and conveyed to the unload conveyor. If another surface on the workpiece requires finishing, the workpiece 12 is sent through the apparatus 100 once again. In a preferred embodiment, the total processing time for one surface is about 6–10 minutes depending on the particular ornament and machine on which the ornament is processed.

The cutting apparatus 200 is preferably a water jet cutting machine sold by, for example, Ingersoll-Rand. The cutting apparatus 200 automatically cuts intricate shapes in the workpiece 12 using a concentrated stream of high-pressure fluid.

One of ordinary skill in the art should recognize that the above-described apparatus 20, 100*a*, 100*b*, and 100*c* can be used in a wide variety of sequences to automatically cold-end finish full-lead crystal ornaments of almost endless variety. A first example of cold-end processing in accordance with the present invention is described with reference to FIGS. 10 and 11*a*–11*d*.

Figure 10:
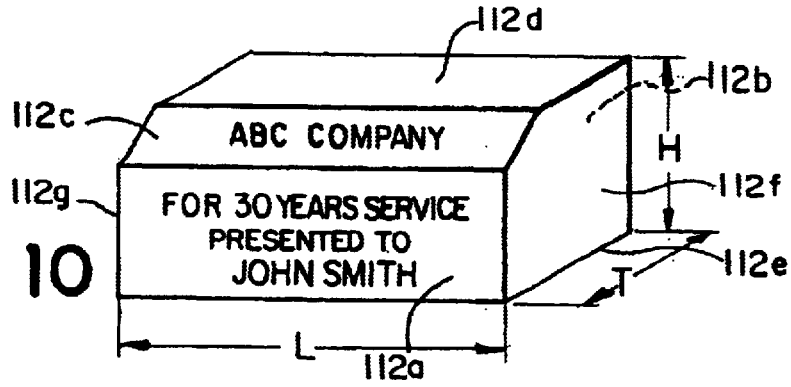
FIG. 10 is a perspective view of a sample full-lead crystal ornament made in accordance with an embodiment of the invention.

FIG. 10 illustrates a full-lead crystal ornament which may be presented to, for example, a retiring employee of a company. The ornament has an enlarged, flat front 112*a* and back 112*b*, a bevelled, top front surface 112*c*, an elongate, top 112*d* and bottom 112*e* surface, and a flat right 112*f* and left 112*g* side surface.

Figure 11A:
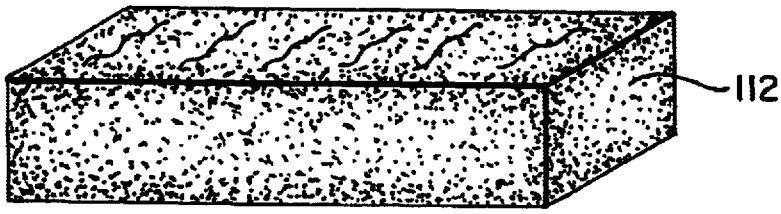
FIG. 11*a*–11*d* are perspective views of a workpiece during intermediate processing steps.

In one method, an elongate crystal slab is loaded into the face surface finishing apparatus 20. As seen in FIG. 11*a*, the all six outer surfaces of the slab are unfinished (as indicated by dots) including the top surface which has chill wrinkle (as indicated by wavy lines). The bottom and top surfaces of the slab are ground and polished (as shown by stars) in the apparatus 20 to the dimensions shown in FIG. 11*b*. The bottom and top polished surfaces of the slab will become the front 112*a* and back 112*b* face surfaces of the ornament.

Figure 11B:
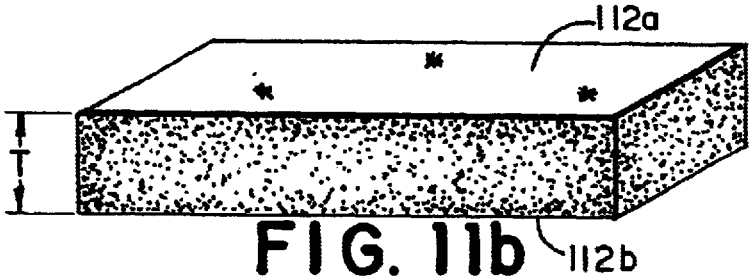
Figure 11C:
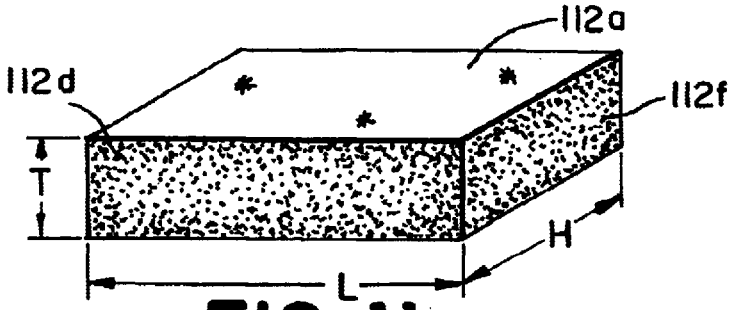
Figure 11D:
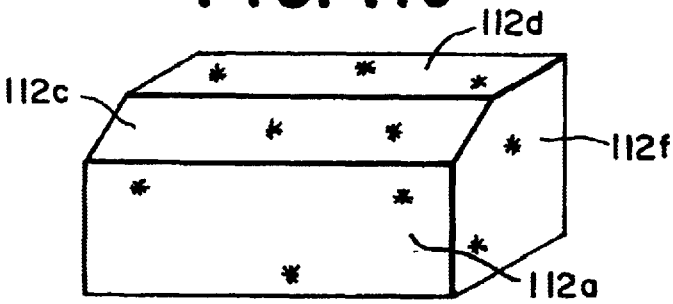

The slab shown in FIG. 11*b* is then cut to the dimensions shown in FIG. 11*c* corresponding to the length L of the ornament. Each unfinished edge surface is then ground and polished using one or more of the edge surface finishing apparatus 100. The apparatus 100 also grinds and polishes the bevelled surface 112*c* at the same time the top surface 112*d* is being ground and polished. Finally, inscription is applied to the face surface using known techniques.

Further examples of full-lead crystal ornaments processed in accordance with the present invention are illustrated in FIGS. 12–18. Each of the ornaments shown in FIGS. 12–18 are copyrighted designs by Crystal Signatures, Inc.

Figure 12A:
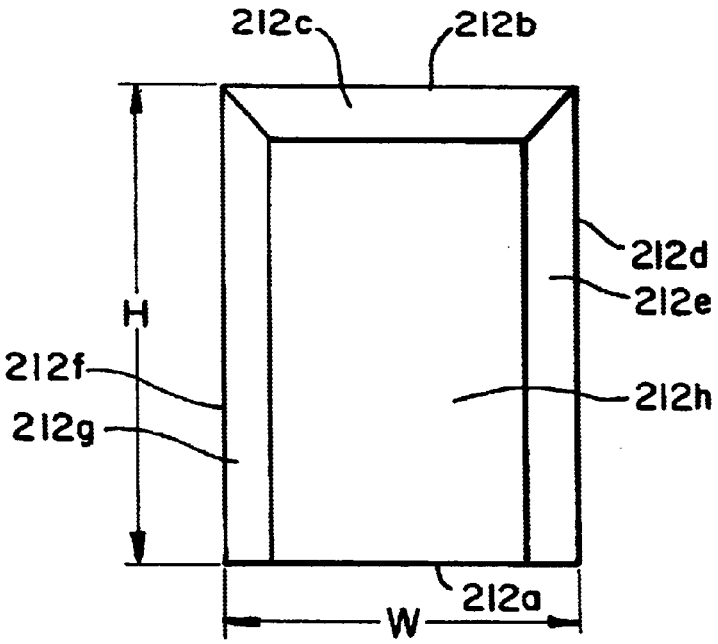
FIGS. 12–17 are examples of full-lead crystal ornaments made using the apparatus and method of the present invention.
Figure 12B:
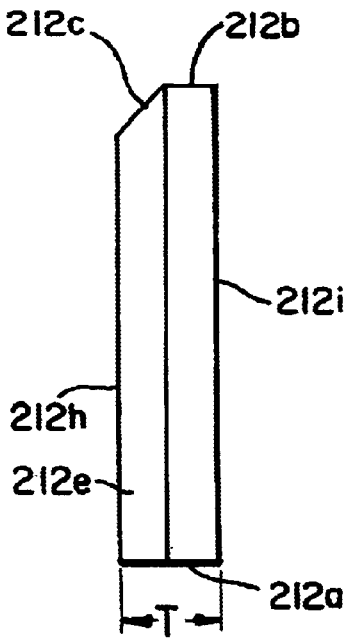

FIGS. 12*a* and 12*b* illustrate an ornament entitled "City Bar" having a thickness T of 37 mm., a width W of 4.5 in., and a height H of 7.5 in.

Initially, the front 212*h* and back 212*i* face surfaces are processed. A full-lead crystal slab of approximately 40 mm.×10 in.×22 in. is passed through the face surface finishing apparatus 20 at least two times, once for each face surface. Additional passes may be required if the slab is warped or uneven. Both face surfaces 212*h*, 212*i* of the slab are ground and polished to a thickness of 37 mm. The slab is then cut by a diamond saw to the rough dimensions of the final ornament.

The edge and bevel surfaces are then processed. The workpiece is first processed through the 14-head edge surface apparatus 100*b* to grind and polish the bottom surface 212*a*. The workpiece 212 is then processed through the 17-head apparatus 100*c* three times to grind and polish the remaining surfaces. In the first pass, the top surface 212*b* and the top bevel 212*c* are simultaneously ground and polished. In the second pass, the right side surface 212*d* and the right side bevel 212*e* are simultaneously ground and polished. In the third pass, the left side surface 212*f* and the left side beveled surface 212*g* are simultaneously ground and polished. The ornament is now completely finished and ready for personalization or shipment.

Figure 13A:
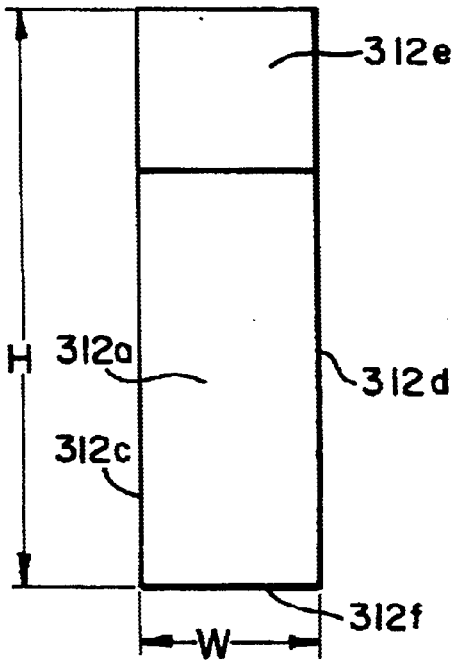
Figure 13B:
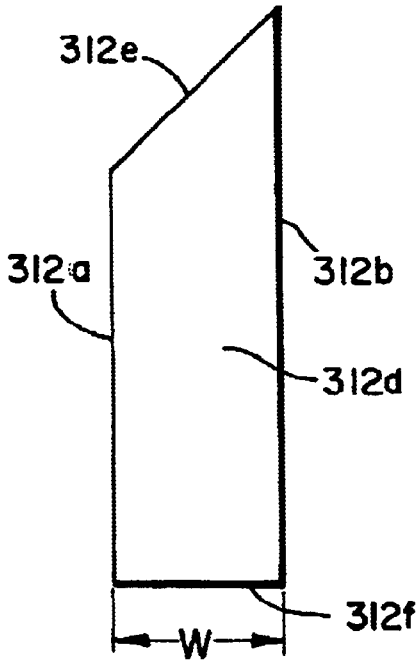

FIGS. 13*a* and 13*b* illustrate an ornament entitled "Tower" having a thickness T of 2 in., a width W of 2 in., and a height H of 8.5 in.

Initially, the front 312*a* and back 312*b* face surfaces are processed. A full-lead crystal slab approximately 50–55 mm.×10 in.×22 in. is processed through the face surface finishing apparatus 20 at least two times, once for each face surface. Additional passes may be required if the slab is warped or uneven. Both face surfaces of the slab are ground and polished to a thickness of 2 in. The slab is then cut into strips of approximately 52 mms. wide×22 in. long using a diamond saw.

The edge and bevel surfaces are then processed. The workpiece is processed through the 14-head edge surface apparatus 100*b* to grind and polish the remaining surfaces. In the first pass, the left side surface 312*c* is ground and polished. In the second pass, the right side surface 312*d* is ground and polished. The workpiece strips are then cut on an angle to create the top bevel surface 312*e* to the rough dimensions of the final ornament. The workpiece is then processed through the 14-head apparatus 100*b* for two more passes to grind and polish the top bevel surface 312*e* and the bottom surface 312*f*.

Figure 14A:
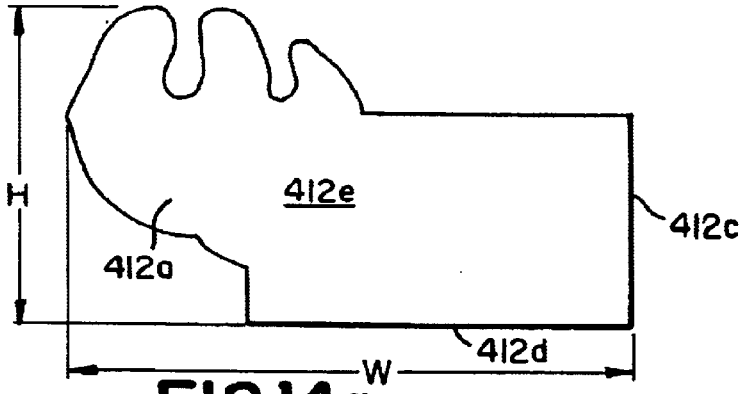
Figure 14B:
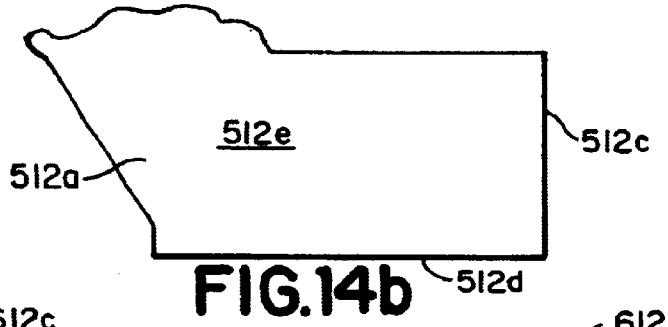

FIGS. 14*a* and 14*b* illustrate theme placque ornaments entitled "Eagle" and "Flag", respectively. The ornaments 412, 512 have a thickness of 19 mm., a width W of 6 in., and a height H of 3.5 in.

Initially, the front and back face surfaces are processed. A full-lead crystal slab approximately 19–20 mm.×10 in.×22 in. is processed through the face surface finishing apparatus 20 at least two times, once for each face surface. Additional passes may be required if the slab is warped or uneven. Both face surfaces of the slab 412*a*, 412*b*, 512*a*, and 512*b* are ground and polished to a thickness of 19 mm.

The slabs are then cut with the programmable water jet machines 200 into the shapes shown in FIGS. 14*a* and 14*b*. The workpieces are then processed through the 14-head edge surface finishing apparatus 100*b* to grind and polish the right side 412*c*, 512*c*, and the bottom surface 412*d*, 512*d*. Finally, a graphical region 412*e*, 512*e* is masked and sandblasted to create a graphical design on the ornament.

Figure 15A:
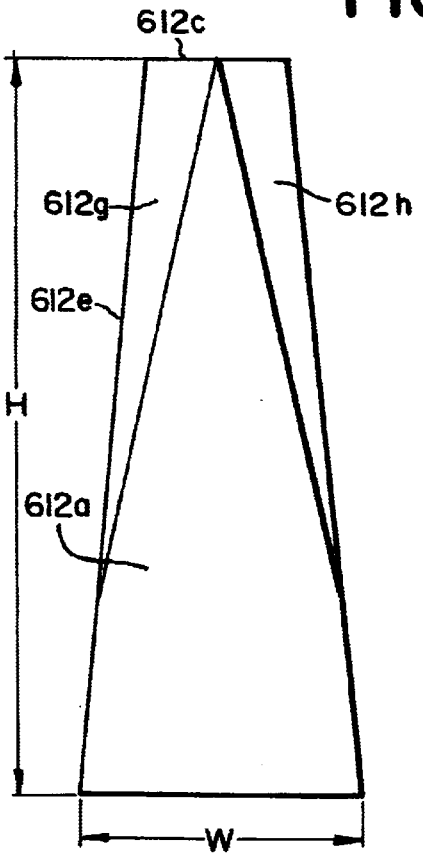
Figure 15B:
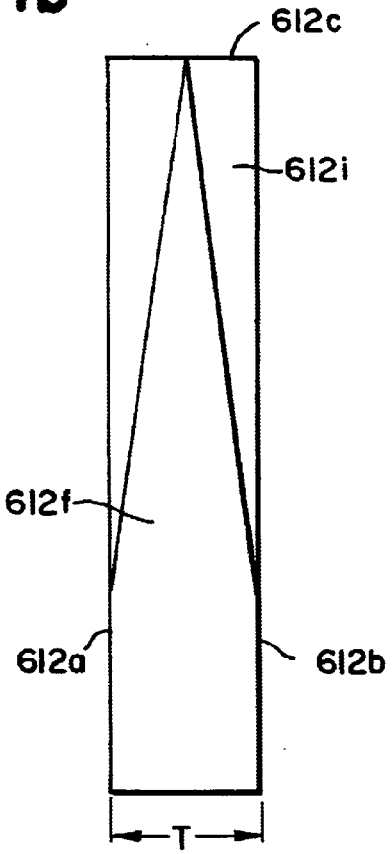

FIGS. 15*a* and 15*b* illustrate an ornament entitled "Obelisk" having a thickness T of 2 in., a width W of 4 in., and a height H of 15 in.

Initially, the front 612*a* and back 612*b* face surfaces are processed. A full-lead crystal slab approximately 55–57 mm.×10 in.×22 in. is processed through the face surface finishing apparatus 20 at least two times, once for each face surface. Additional passes may be required if the slab is warped or uneven. Both face surfaces of the slab are ground and polished to a thickness of 2 in.

The edge surfaces are then processed. The workpiece is processed through the 14-head edge surface apparatus 100*b* to grind and polish the top 612*c*, bottom 612*d*, left side 612*e* and right side 612*f*.

The bevel surfaces are then processed. The workpiece is processed through the 17-head edge surface apparatus 100*c* to grind and polish the left 612*g* and right 612*h* front bevel surfaces and the left 612*i* and 612*j* back top bevel surfaces. The workpiece is fixtured at the desire angle as it passes through the 17-head surface apparatus 100*c*.

Figure 16A:
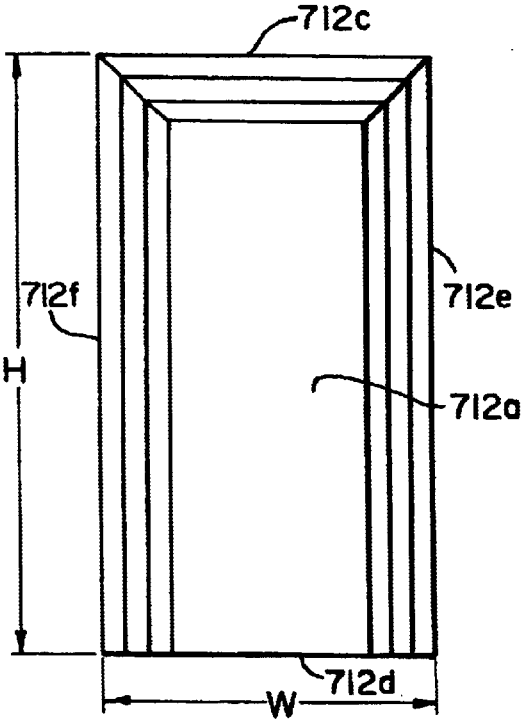
Figure 16B:
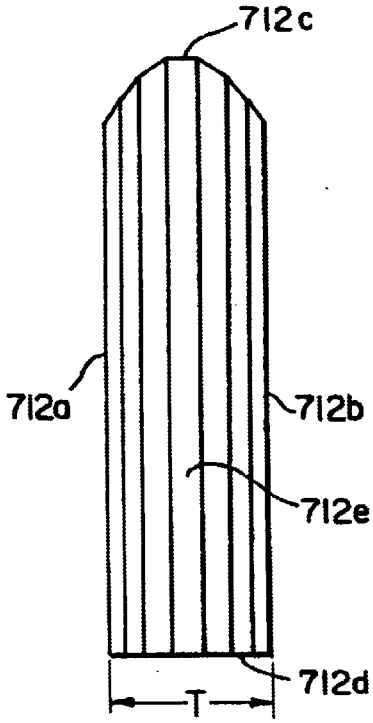

FIGS. 16*a* and 16*b* illustrate an ornament entitled "Super Bevel Sculpture" having a thickness T of 2 in. a width W of 4.75 in., and a height H of 9.5 in.

Initially, the front 712*a* and back 712*b* face surfaces are processed. A full-lead crystal slab 55–57 mm.×10 in.×22 in. is processed through the face surface finishing apparatus 20 at least two times, once for each face surface. Both face surfaces of the slab are ground and polished to a thickness of 2 in. The slab is then cut by a diamond saw to the rough dimensions of the final ornament.

The edge surfaces are then processed. The workpiece is processed through the 14-head edge surface apparatus 100*b* to grind and polish the top 712*c*, bottom 712*d*, right 712*e*, and left 712*f* side surfaces of the ornament.

The bevel surfaces are then processed. The workpiece is processed through the 17-head edge surface apparatus 100*c* to grind and polish the multiple beveled surfaces on the front and back.

Figure 17A:
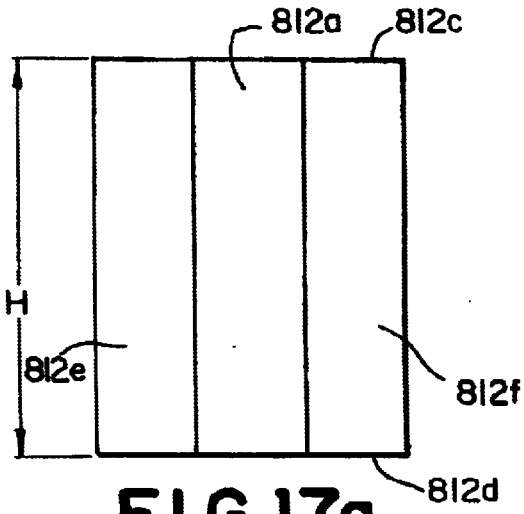
Figure 17C:
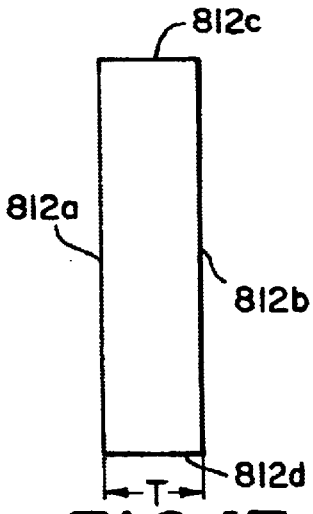
Figure 17B:
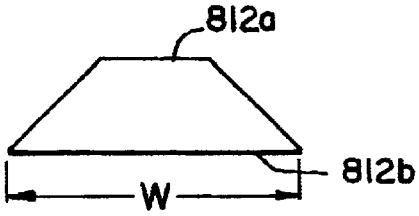

FIGS. 17*a*, 17*b* and 17*c* illustrate an ornament entitled "Trapezoid" having a thickness T of 37 mm., a width W of 5 in., and height H of 6.75 in.

Initially, the front 812*a* and back 812*b* face surfaces are processed. A full-lead crystal slab 40–44 mms.×10 in.×22 in. is processed through the face surface finishing apparatus at least two times, once for each face surface. Both face surfaces of the slab are ground and polished to a thickness of 37 mm. The polished slab is then cut by a diamond saw to the rough dimensions of the final ornament.

The top 812*c* and bottom 812*d* surfaces are then processed. The workpiece is processed through the 14-head edge surface apparatus 100*b* to grind and polish the top 812*c* and bottom 812*d* surfaces.

The bevel surfaces 812*e*, 812*f* are then processed. The workpiece is processed through the 17-head edge surface apparatus 100*c* to grind and polish the left bevel 812*e* and the right bevel 812*f*.

What is claimed is:

1. An apparatus for grinding and polishing the face surface of a full-lead crystal workpiece, comprising;

a) a housing having an entrance end and an exit end;

b) a conveyor running lengthwise downline through said housing from the entrance end to the exit end;

c) a calibrator proximate the entrance end of said housing;

d) a plurality of grinders located downline of said calibrator, said grinders having an abrasive grinding surface within a range of coarseness;

e) a plurality of polishers located downlime of said grinders, said polishers having an abrasive polishing surface;

f) control means for raising and lowering said calibrator, grinders and polishers relative to said belt conveyor and the unfinished surface of the workpiece supported thereon;

wherein said grinders and polishers are constructed and arranged to automatically process full-lead crystal without visible flaws.

2. The apparatus recited in claim 1, said conveyor comprising unpowered, roll conveyors located proximate the entrance end and the exit end of said housing, and a variable-speed, endless-belt processing conveyor intermediate said roll conveyors.

3. The apparatus recited in claim 1, including grinding fluid source, polishing fluid source, and a lubricating fluid nozzle proximate said calibrator and each of said grinders and polishers, said nozzles being connected to said grinding and polishing fluid source and directing the flow of fluid onto the unfinished surface of the workpiece.

4. The apparatus recited in claim 3, including a fluid-flow valve controlling the flow of fluid through each of said exit nozzles.

5. The apparatus recited in claim 4, including a bifurcated collection basin located underneath said housing for separately collecting and recycling the grinding and polishing fluid emitted from said nozzles.

6. The apparatus recited in claim 1, including a dryer located proximate the exit end of said housing.

7. The apparatus recited in claim 1, each of said calibrator, grinders and polishers having an independent, motor and an abrasive head.

8. The apparatus recited in claim 7, said calibrator head and said grinding heads having a tapered leading, abrasive cutting surface.

9. The apparatus recited in claim 8, said calibrator head having a coarseness in the range of about 30 grit to about 50 grit.

10. The apparatus recited in claim 8, wherein each grinding head has a coarseness different than another grinding head.

11. The apparatus recited in claim 10, said grinding heads having a coarseness in the range of about 60 grit to about 800 grit.

12. The apparatus recited in claim 11, said grinders being arranged sequentially downline within the housing in an order of decreased coarseness.

13. The apparatus recited in claim 7, said polishing heads comprising an abrasive, perforated pad.

14. The apparatus recited in claim 11, said grinding heads comprising a circular base plate having replaceable grinding pads fixed to said base plate.

15. The apparatus recited in claim 1, said calibrator, grinders and polishers being located above said belt conveyor.

16. An apparatus for bevelling, grinding and polishing an edge surface of a full-lead crystal workpiece, comprising:

a) a housing having an entrance end and an exit end;

b) a conveyor running lengthwise downline through said housing from the entrance end to the exit end, said conveyor supporting the workpiece without contacting the edge surface of the workpiece;

c) a plurality of grinders having an abrasive grinding surface within a range of coarseness;

d) a plurality of polishers located downline of said grinders, said polishers having an abrasive polishing surface within a range of coarseness;

e) control means for raising, lowering and tilting said grinders and polishers relative to said conveyor and the unfinished edge surface of the workpiece supported thereon;

wherein said grinders and polishers are constructed and arranged to automatically process full-lead crystal without visible flaws.

17. The apparatus recited in claim 16, said conveyor comprising variable-speed endless-belt load and unload conveyor located proximate the entrance end and the exit end, respectfully, of said housing, and a variable-speed, endless-belt processing conveyor intermediate said roll conveyors.

18. The apparatus recited in claim 17, said processing belt conveyor comprising a pair of vertically-oriented, conveyor belts.

19. The apparatus recited in claim 18, including means for adjusting the distance between said vertically-oriented conveyor belts.

20. A system for cold-end processing a full-lead crystal workpiece, comprising:

a) an apparatus for grinding and polishing the face surface of a full-lead crystal workpiece, having i) a housing having an entrance end and an exit end;

ii) a conveyor running lengthwise downline through said housing from the entrance end to the exit end;

iii) a calibrator proximate the entrance end of said housing;

iv) a plurality of grinders located downline of said calibrator, said grinders having an abrasive grinding surface within a range of coarseness;

v) a plurality of polishers located downline of said grinders, said polishers having an abrasive polishing surface with a range of coarseness;

vi) control means for raising and lowering said calibrator, grinders and polishers and positioning said calibrator, grinders and polishers relative to said belt conveyor and the unfinished surface of the workpiece supported thereon;

b) an apparatus for bevelling, grinding and polishing an edge surface of a full-lead crystal workpiece, having:

i) a housing having an entrance end and an exit end;

ii) a conveyor running lengthwise downline through said housing from the entrance end to the exit end, said conveyor supporting the workpiece without contacting the edge surface of the workpiece;

iii) a plurality of grinders, said grinders having an abrasive grinding surface within a range of coarseness and being arranged sequentially downline within the housing;

iv) a plurality of polishers located downline of said grinders, said polishers having an abrasive polishing surface within a range of coarseness and being arranged sequentially downline within the housing;

v) control means for raising, lowering and tilting said grinders and polishers relative to said conveyor and positioning said grinders and polishers relative to said conveyor and the unfinished edge surface of the workpiece supported thereon.

* * * * *